US007353684B2

(12) United States Patent
Lee

(10) Patent No.: US 7,353,684 B2
(45) Date of Patent: Apr. 8, 2008

(54) METHOD AND APPARATUS OF MANUFACTURING DRUM

(75) Inventor: Soon Jo Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 26 days.

(21) Appl. No.: 10/860,153

(22) Filed: Jun. 4, 2004

(65) Prior Publication Data

US 2004/0244168 A1 Dec. 9, 2004

(30) Foreign Application Priority Data

Jun. 5, 2003 (KR) ..... 10-2003-0036393

(51) Int. Cl.

| | |
|---|---|
| ***B21D 41/00*** | (2006.01) |
| ***B21D 41/04*** | (2006.01) |
| ***B21D 22/00*** | (2006.01) |
| ***B21B 15/00*** | (2006.01) |

(52) U.S. Cl. ..... 72/370.1; 72/370.02; 72/68; 72/348

(58) Field of Classification Search ..... 72/370.1, 72/370.11, 370.12, 370.02, 370.25, 51, 370, 72/370.01, 115, 118, 124; 100/42, 244, 264; 29/894.353; 228/151, 155; 219/64
See application file for complete search history.

(56) References Cited

U.S. PATENT DOCUMENTS

| | | | | |
|---|---|---|---|---|
| 1,698,999 | A * | 1/1929 | Hothersall | 72/353.2 |
| 3,163,142 | A * | 12/1964 | Buhrke | 72/344 |
| 3,272,671 | A * | 9/1966 | Gaylord et al. | 156/86 |
| 3,765,351 | A * | 10/1973 | Kubacki et al. | 72/105 |
| 4,170,888 | A * | 10/1979 | Golata | 72/82 |
| 4,697,446 | A * | 10/1987 | Yamamoto et al. | 72/178 |
| 4,890,786 | A * | 1/1990 | Oberhofer et al. | 229/5.7 |
| 5,784,911 | A * | 7/1998 | Hashimoto et al. | 72/52 |
| 5,950,472 | A | 9/1999 | Grotnes et al. | |
| 5,996,386 | A * | 12/1999 | Pazzaglia | 72/84 |
| 2002/0189070 | A1 | 12/2002 | Noel et al. | |

FOREIGN PATENT DOCUMENTS

| | | |
|---|---|---|
| FR | 2 667 521 | 4/1992 |
| GB | 20898 | 9/1907 |
| GB | 136510 | 12/1919 |
| GB | 283673 | 1/1928 |
| GB | 399132 | 9/1933 |
| GB | 1059002 | 2/1967 |
| JP | 07-155869 | 6/1995 |
| JP | 10-249459 | 9/1998 |
| JP | 11 342429 | 12/1999 |
| JP | 2001-259769 | 9/2001 |
| JP | 2002-038936 | 2/2002 |
| WO | WO 94/27280 | 11/1994 |

OTHER PUBLICATIONS

European Search Report, dated Oct. 15, 2004.

* cited by examiner

*Primary Examiner*—Derris H. Banks
*Assistant Examiner*—Teresa M Bonk
(74) *Attorney, Agent, or Firm*—McKenna Long & Aldridge LLP

(57) ABSTRACT

An apparatus and method of manufacturing a drum, for use in an appliance such as a dryer, that prevents noise and vibration during operation. The method involves forming a cylindrical drum; reducing a diameter at both ends of the drum; forming beads in a central part of the drum; and bending both edges of the drum.

11 Claims, 12 Drawing Sheets

METHOD AND APPARATUS OF MANUFACTURING DRUM

This application claims the benefit of Korean Application No. P2003-36393 filed on Jun. 5, 2003, which is hereby incorporated by reference.

BACKGROUND OF THE INVENTION

1. Field of the Invention

The present invention relates to an apparatus and method of manufacturing a drum, and more particularly, to an apparatus and method of manufacturing a drum for a dryer so as to prevent noise and vibration.

2. Discussion of the Related Art

In general, a dryer is an apparatus for drying laundry, such as clothes, that are placed inside a cabinet, and where hot air is heated by an electric heater or a gas combustion device. A demand for dryers has increased continuously.

FIG. 1 is a disassembled perspective view illustrating a dryer in accordance with the related art.

As shown in FIG. 1, a related art drum 1 is provided inside of a cabinet (not shown), where the cabinet forms the exterior of the dryer. The drum 1 has a cylindrical shape with open front and rear sides. Also, a belt groove 2 is provided on an outer surface of the drum 1, on which a belt (not shown) connected to a motor is wound.

Furthermore, the drum 1 has a chamber 5 that receives laundry and has a plurality of lifts 6 protruding from an inner surface thereof. That is, when the drum 1 is rotated, the lifts 6 are provided to lift and drop the laundry, whereby the laundry is turned over. Accordingly, the laundry is dried in a short time. Also, a front support 7 and a rear support 9 are respectively provided in the front and rear sides of the drum 1. The front and rear supports 7 and 9 simultaneously close and support the front and rear sides of the drum 1.

Meanwhile, a sealing member 10 is provided between the drum 1 and the front support 7/rear support 9. A plurality of rollers (not shown) are also provided between the front support 7 and the rear support 9 which correspond to the front and rear sides of the drum 1 so as to support the drum 1.

An opening 8 is also provided in the front support 7, whereby the chamber 5 communicates with the outside through the opening 8. The opening 8 is selectively closed or opened with a door (not shown). In the rear support 9, a supply duct 12 communicates with the chamber 5, whereby heated air is provided to the chamber 5 through the supply duct 12.

Also, an outlet assembly 13 is provided in one side of the front support 7 corresponding to a lower part of the opening 8 provided in the front support 7, whereby air from the chamber 5 is discharged through the outlet assembly 13. The outlet assembly 13 is provided with a filter 14 for filtering foreign particles (for example, dust or thread) from the air discharging through the chamber 5.

The outlet assembly 13 communicates with an exhaust duct 15 where the filter 14 is provided in the exhaust duct 15. Also, the exhaust duct 15 is connected with a fan housing 18. Here, air inside the chamber 5 flows along the exhaust duct 15 and the fan housing 18 as a fan 17 mounted inside the fan housing 18 is operated. The fan 17 is a centrifugal fan for improving space efficiency. However, it is possible to use an axial fan.

Additionally, one side of the fan housing 18 communicates with the exhaust duct 15, and another side of the fan housing 18 communicates with an exhaust pipe 19. Accordingly, the air passing through the fan housing 18 is exhausted to the outside through the exhaust pipe 19.

Meanwhile, the supply duct 12 communicates with a guide funnel 16. The guide funnel 16 is formed in a truncated conic shape so as to guide the heated air to the supply duct 12. The guide funnel 16 is provided with a gas combustion device 20 having a valve, a mixing pipe, and an igniter. Herein, the valve is connected to a gas pipe so as to control a gas provision, the mixing pipe mixes the gas sprayed from a gas nozzle to the air, and the igniter ignites the mixed gas.

A method of manufacturing the drum applied to the related art dryer will be described as follows.

Referring to FIG. 2, a metal plate such as a stainless steel plate is rolled, and a seam is welded. Then, a central diameter of the drum is expanded while maintaining a diameter at both ends of the drum. The central diameter of the drum is expanded using a method of pressing an inner side of the drum toward the outside with a plurality of dies. After that, a bead process is performed in a central part of the drum. That is, a plurality of grooves are provided along an outer surface of the drum for strengthening the drum. Also, a hemming process is performed using a method of bending the end at both ends of the drum.

The method of manufacturing the drum for the dryer according to the related art has the following disadvantages. The central part of the drum is expanded with the die provided in the inner surface of the drum. That is, the die presses the central part of the drum toward the outside. On completion of the manufacturing process steps of the drum, traces of the dies may remain on the drum when the dies are separated from the central part of the drum, thereby deteriorating the exterior of the drum. Also, if the circular shape of the drum is damaged, it is impossible to obtain uniform rotation inertia, thereby generating noise and vibration during rotation of the drum.

SUMMARY OF THE INVENTION

Accordingly, the present invention is directed to an apparatus and a method of manufacturing a drum that substantially obviates one or more problems due to limitations and disadvantages of the related art.

An object of the present invention is to provide an apparatus and method of manufacturing a drum for a dryer that prevents noise and vibration.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of manufacturing a drum includes forming a cylindrical drum; reducing a diameter at both ends of the drum; forming beads in a central part of the drum; and bending both edges of the drum.

Forming a cylindrical drum is performed by rolling a metal sheet, and welding a seam. The metal sheet is formed of stainless steel.

Reducing a diameter at both ends of the drum is performed by inserting both ends of the drum between dies provided to inner and outer surfaces of the drum. Forming beads in a central part of the drum is performed by pressing an outer surface of the drum with rollers.

In another aspect, an apparatus of manufacturing a drum includes an upper die assembly having a motor, an upper cam connected with a rotation axis of the motor, an upper core die provided to be expanded or reduced in a radial direction along the upper cam, and an upper outer die independently provided in the outside of the upper core die to be movable in an upward and downward direction; a middle die assembly having an axis provided in line with the rotation axis of the motor, a middle cam provided on one side of the axis, and a middle core die having grooves on an outer surface thereof and provided to be expanded or reduced in a radial direction along the middle cam; a lower die assembly having a motor, a lower cam connected with a rotation axis of the motor, a lower core die provided to be expanded or reduced in a radial direction along the lower cam, and a lower outer die independently provided in the outside of the lower core die to be movable in an upward and downward direction; and a press pressing the upper die assembly.

The apparatus further includes rollers provided at fixed intervals from the grooves, which are movable in the radial direction of the drum. Also, inclined surfaces sliding along the cams are provided on inner surfaces of the respective core dies.

The upper core die has a profile of decreasing an upper diameter of the drum, and the upper outer die has a profile corresponding to the upper core die at a predetermined interval from the upper core die. The lower core die has a profile of decreasing a lower diameter of the drum, and the lower outer die has a profile corresponding to the upper core die at a predetermined interval from the upper core die.

Also, a diameter corresponding to an upper part of the drum is reduced by inserting the upper part of the drum between the upper core die and the upper outer die as the upper die assembly is moved downward. A diameter corresponding to a lower part of the drum is reduced by inserting the lower part of the drum between the lower core die and the lower outer die as the upper die assembly is moved downward.

In another aspect, a method of manufacturing a drum with an apparatus including an upper die assembly having a motor, an upper cam connected with a rotation axis of the motor, an upper core die provided to be expanded or reduced in a radial direction along the upper cam, and an upper outer die independently provided in the outside of the upper core die to be movable in an upward and downward direction; a middle die assembly having an axis connected in line with the rotation axis of the motor, a middle cam provided in one side of the axis, and a middle core die having grooves for an outer surface thereof and provided to be expanded or reduced in a radial direction along the middle cam; a lower die assembly having a motor, a lower cam connected with a rotation axis of the motor, a lower core die provided to be expanded or reduced in a radial direction along the lower cam, and a lower outer die independently provided in the outside of the lower core die to be movable in up and down direction; and a press pressing the upper die assembly, the method includes loading the cylindrical drum to an outer surface of the middle core die; reducing a diameter at both ends of the drum; forming beads in a central part of the drum; bending both edges of the drum; and unloading the drum.

Reducing a diameter at both ends of the drum includes reducing the diameter corresponding to an upper part of the drum by inserting the upper part of the drum between the upper core die and the upper outer die as the upper die assembly is moved downward; and reducing the diameter corresponding to a lower part of the drum by inserting the lower part of the drum between the lower core die and the lower outer die as the upper die assembly is moved downward.

Also, forming beads in a central part of the drum includes rotating the core dies by driving the motor and pressing the outer surface of the drum along the grooves of the core dies with rollers.

Also, unloading the drum includes contracting the core dies so as to avoid interference between the drum and the core dies; and unloading the drum after the upper die assembly is moved upward. Also, contracting the core dies is performed as inclined surfaces provided on inner surfaces of the core dies slide along the respective cams.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings. Wherever possible, the same reference numbers are used throughout the drawings to refer to the same or like parts.

Hereinafter, a drum for a dryer according to the present invention are described with reference to FIGS. 3-6G.

Figure 1:
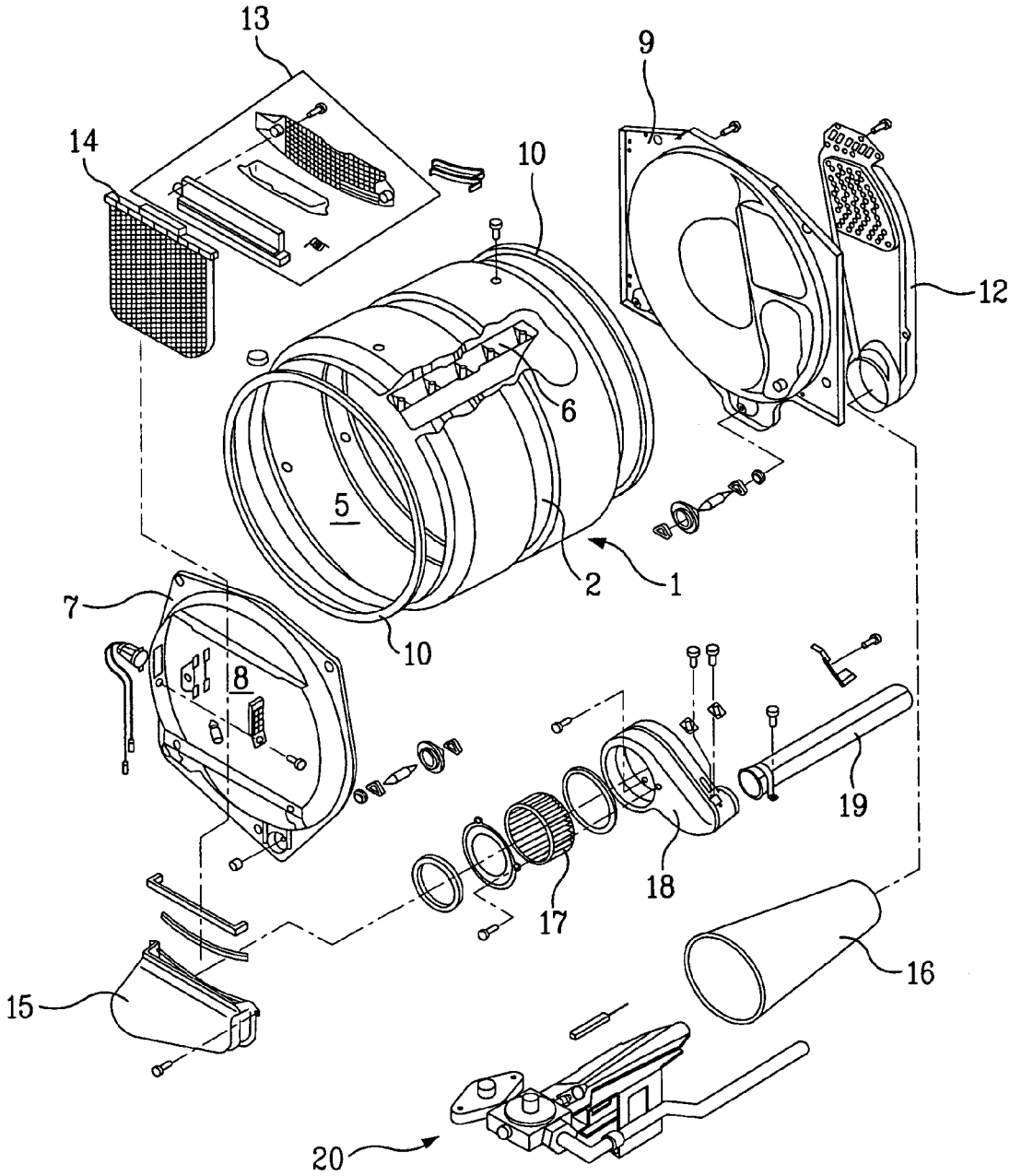
FIG. 1 Related Art
FIG. 1 is a disassembled perspective view illustrating a related art dryer.
Figure 2:
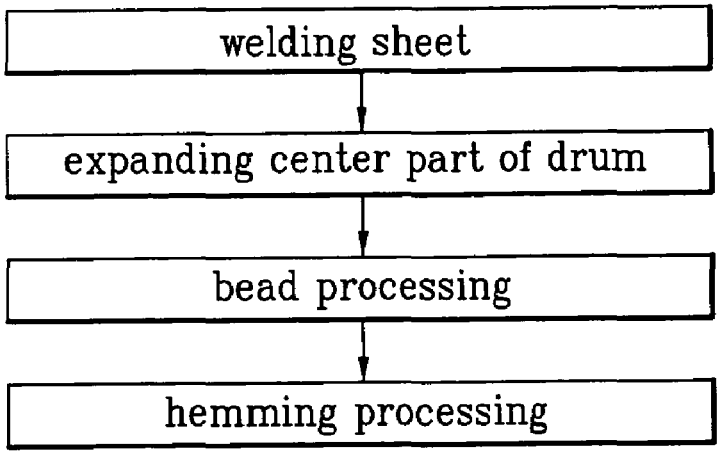
FIG. 2 Related Art
FIG. 2 is a block diagram illustrating a method of manufacturing a drum according to the related art.
Figure 3:
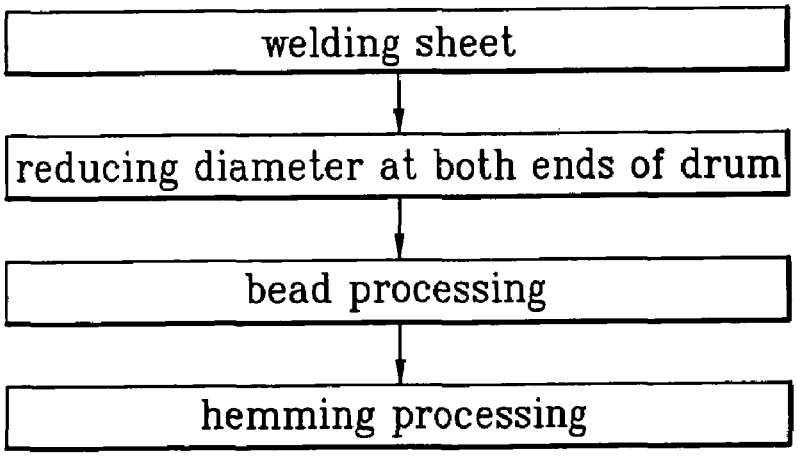
FIG. 3 is a block diagram illustrating a method of manufacturing a drum according to the present invention.
Figure 4:
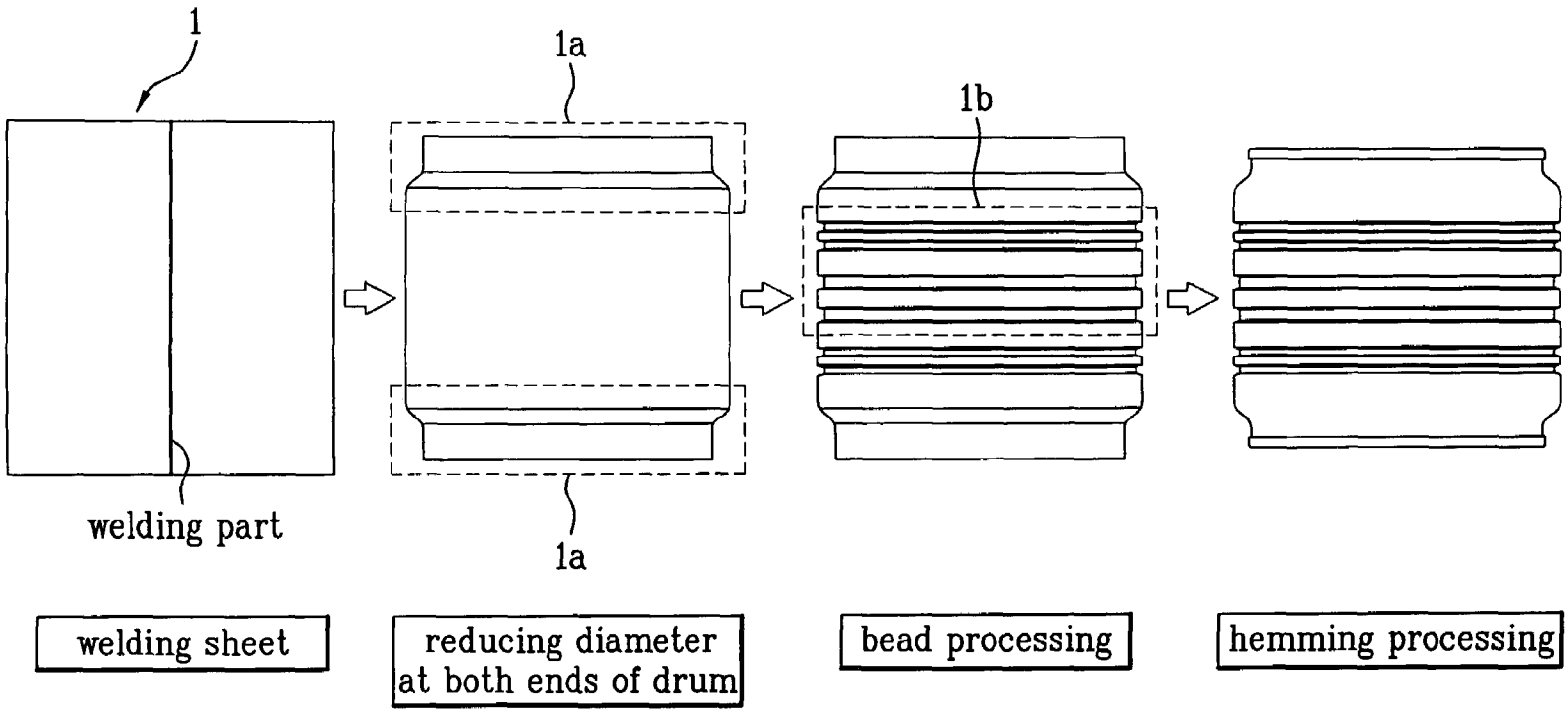
FIG. 4 illustrates a drum during the manufacturing process of FIG. 3 according to the present invention.

FIG. 3 is a block diagram illustrating a method of manufacturing a drum according to the present invention. FIG. 4 illustrates the drum during the manufacturing process steps of FIG. 3.

Referring to FIG. 3 and FIG. 4, a method of manufacturing a drum according to the present invention includes forming a cylindrical drum 1, reducing a diameter at both ends 1*a* of the drum 1, forming a bead, and bending both edges 1*b* at the ends of the drum 1.

A metal sheet such as one made of stainless steel is rolled in a cylindrical shape, and a seam is welded, thereby forming the drum 1. Then, a plurality of beads 1*b* are provided in a circular direction in a central part of the drum 1 so as to strengthen the drum 1. The beads 1*b* are formed in a circular direction by pressing an outer surface of the drum 1 with rollers 70 during rotation of the drum 1. The edges 1*b* of the drum 1 are then bent.

In accordance with the present invention, both ends 1*a* of the drum 1 have a diameter less than the diameter of the central part of the drum 1. To further illustrate, dies are provided which correspond to inner and outer surfaces of the drum 1 at both ends of the drum 1. The drum 1 is inserted into the dies, and is pressed with the dies, thereby reducing the diameter at both ends of the drum 1.

In accordance with the present invention, both ends of the drum are reduced according to the following reasons.

If the metal sheet is rolled in a cylindrical shape and the seam is welded, a radius is not uniform in all portions of the drum. Accordingly, if the central part of the drum expands during pressing, the radius may be different in the portions of the central part of the drum. To further illustrate, the portion of the drum having the small diameter expands at a high rate, and the portion of the drum having the large diameter expands at a low rate, whereby traces remain on the drum. Furthermore, the drum has a different radius at the portions of the central part of the drum in a circular direction, whereby the cylindrical shape of the drum is not uniform.

As mentioned above, in the method of manufacturing the drum according to the related art, it is impossible to obtain a uniform cylindrical shape of the drum and uniform rotation inertia, thereby generating noise and vibration during rotation of the drum. In order to overcome these problems, a method of reducing both ends of a drum is used instead of expanding the central part of the drum according to the related art.

Hereinafter, an apparatus and method of manufacturing a drum 1 according to the present invention will be described with reference to the accompanying drawings.

Figure 5:
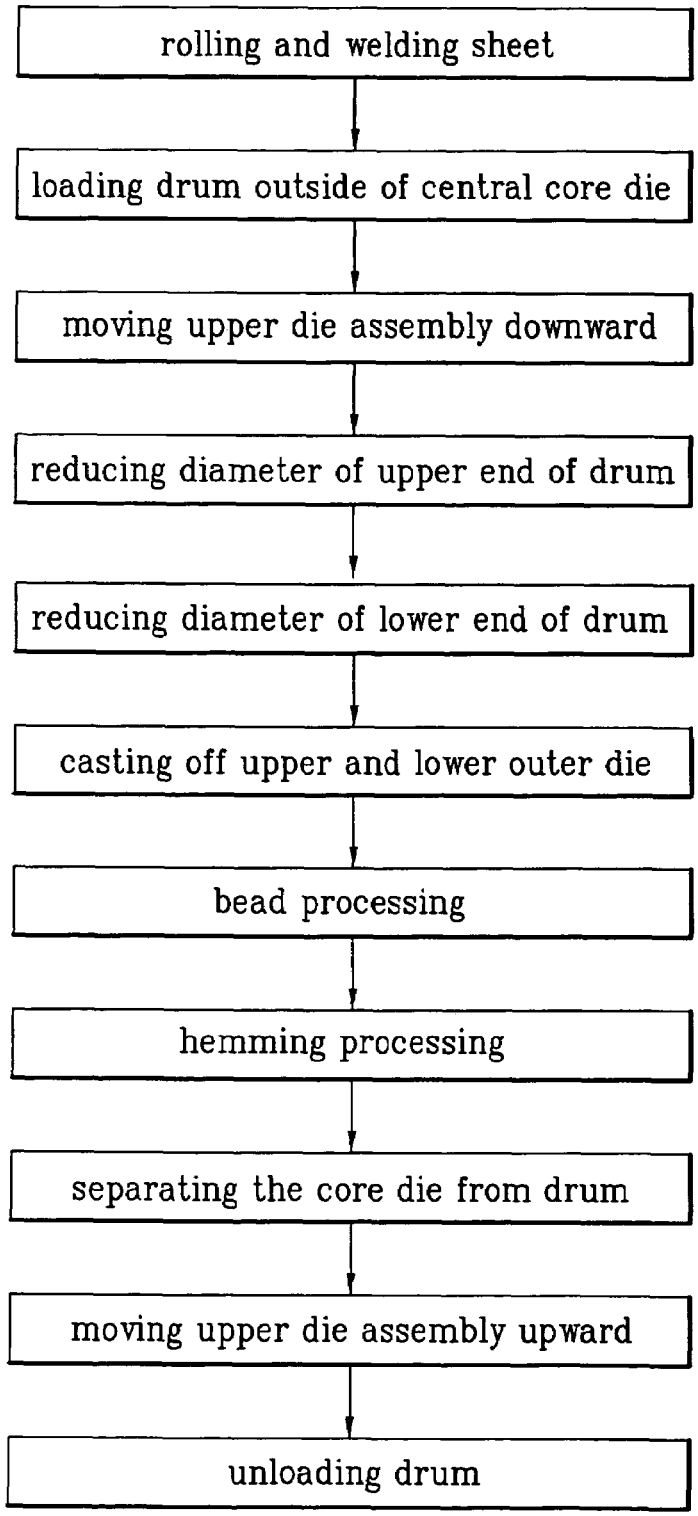
FIG. 5 is a block diagram illustrating a detailed method of manufacturing a drum according to the present invention.

FIG. 5 is a block diagram illustrating a detailed method of manufacturing a drum according to the present invention. FIGS. 6A-6G illustrate the drum and an apparatus for manufacturing the drum according to the present invention.

Figure 6A:
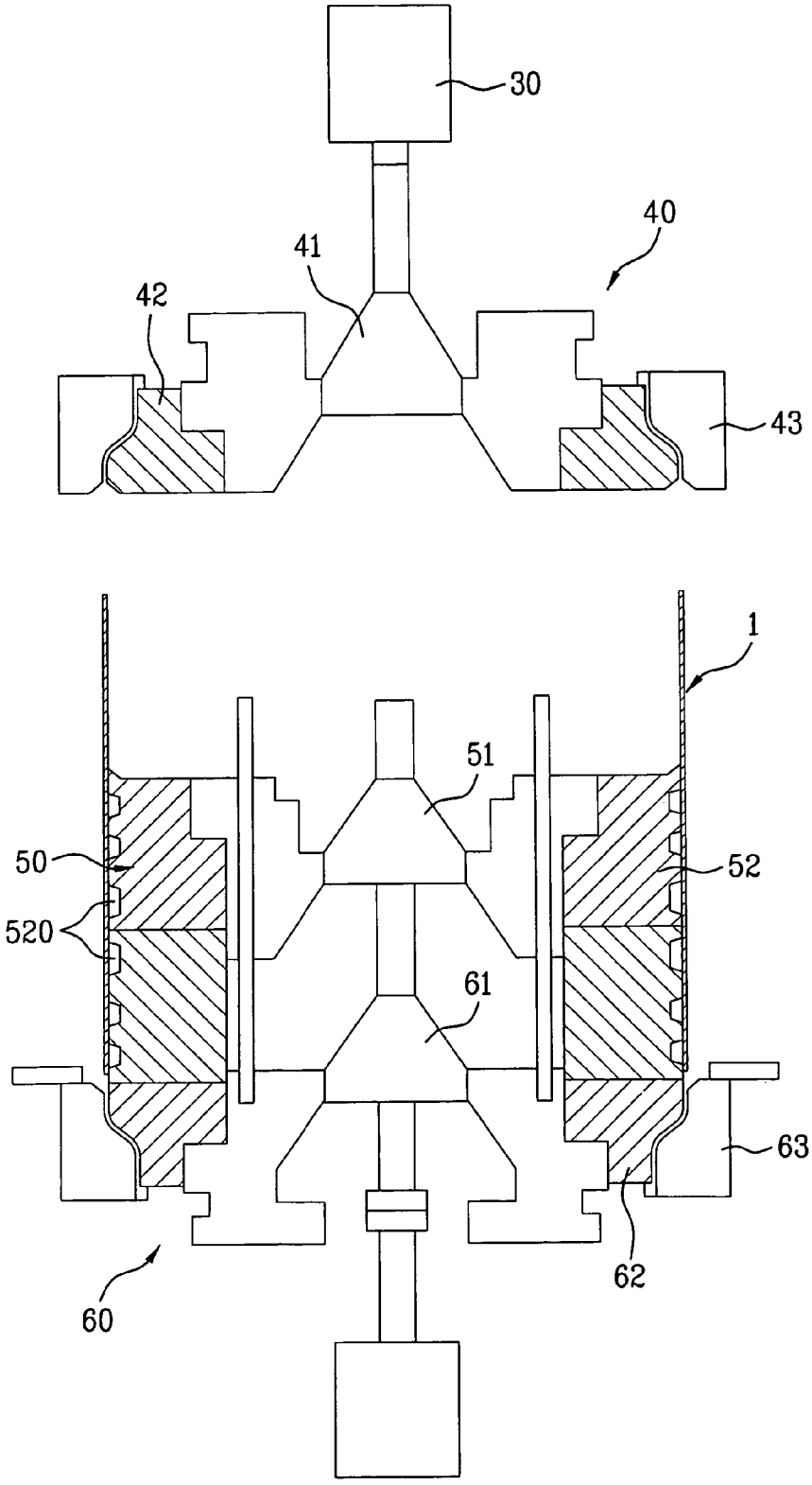
FIGS. 6A-6H illustrate a drum and die during manufacturing of the drum according to the present invention.

As shown in FIG. 6A, the apparatus of manufacturing the drum according to the present invention has an upper die assembly 40, a lower die assembly 60, a middle die assembly 50, and a press (not shown).

The upper die assembly 40 is provided with a motor 30, an upper cam 41, an upper core die 42, and an upper outer die 43. Also, the upper die assembly 40 is pressed with the press. The upper cam 41 is connected with a rotation axis of the motor 30, and the upper core die 42 may be expanded or reduced in a radial direction along the upper cam 41. Also, the upper outer die 43 is independently provided outside of the upper core die 42. The upper outer die 43 is movable in an upward and downward direction.

The middle die assembly 50 is provided with a middle cam 51 and a middle core die 52. The middle cam 51 is in line with the rotation axis of the motor 30, and the middle core die 52 expands or reduces in a radial direction along the middle cam 51.

The lower die assembly 60 has the same structure as the upper die assembly 40, and the lower die assembly 60 is opposite the upper die assembly 40. The lower die assembly 60 is provided with a lower cam 61, a lower core die 62, and a lower outer die 63.

The lower cam 61 is in an axis penetrating the middle core die 52, and the lower core die 62 expanded or reduced in a radial direction along the lower cam 61. Also, the lower outer die 63 is independently provided outside of the lower core die 62. The lower outer die 63 is movable in an upward and downward direction.

The respective core dies 42, 52 and 62 are formed in a cylindrical shape for being in contact with an inner surface of the drum 1, and are separated in a circular direction according to a predetermined angle for expansion or reduction in a radial direction.

The respective core dies 42, 52 and 62 are expanded and reduced in the radial direction as will be discussed below.

As shown in FIG. 6A, the core dies 42, 52 and 62 expand in the radial direction, for being in contact with the inner surface of the drum 1. The core dies have inclined surfaces therein. FIG. 6G illustrates the core dies 42, 52 and 62 contracted in a radial direction as the inclined surfaces of the core dies slide along the respective cams 41, 51 and 61. As the axis having the cams is moved in an upward and downward direction, the cams slide along the inclined surfaces, and the core dies expand or reduce in the radial direction.

Hereinafter, a method of manufacturing a drum with the aforementioned apparatus in accordance with the present invention will be described with reference to FIGS. 6A-6H.

FIG. 6A illustrates a drum before reducing both ends of the drum. As shown in FIG. 6A, the cylindrical drum 1 is inserted to the outside of the middle core die 52 in the apparatus for manufacturing the drum. In this embodiment, the cylindrical drum 1 is formed by rolling the metal sheet and welding the seam thereof. After inserting the cylindrical drum 1 to the outside of the middle core die 52, the cylindrical drum 1 is supported by the middle core die 52 and the lower core die 62, and the upper core die 42 is not moved.

Figure 6B:
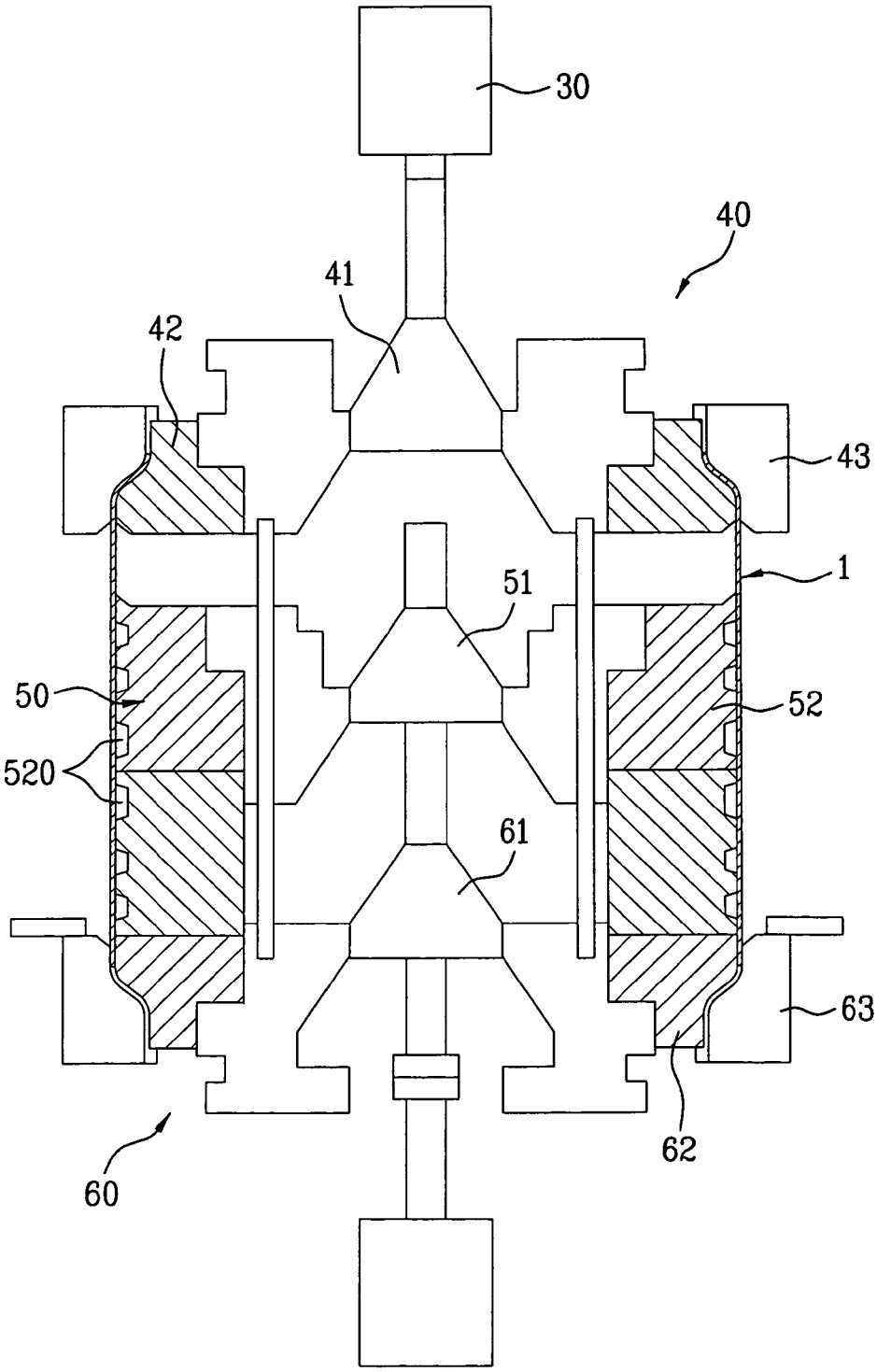

FIG. 6B illustrates reducing a diameter corresponding to an upper part of the drum as the upper die assembly is moved in a downward direction. After loading the cylindrical drum 1 to the outside of the core die in the apparatus for manufacturing the drum, the upper core assembly 40 is pressed in a downward direction by a press (not shown). The upper part of the drum 1 is inserted between the upper core die 42 and the upper outer die 43, whereby the diameter corresponding to the upper part of the drum 1 is reduced. To further illustrate, the upper part of the drum 1 is reduced according to an outer surface of the upper core die 42 and an inner surface of the upper outer die 43.

Figure 6C:
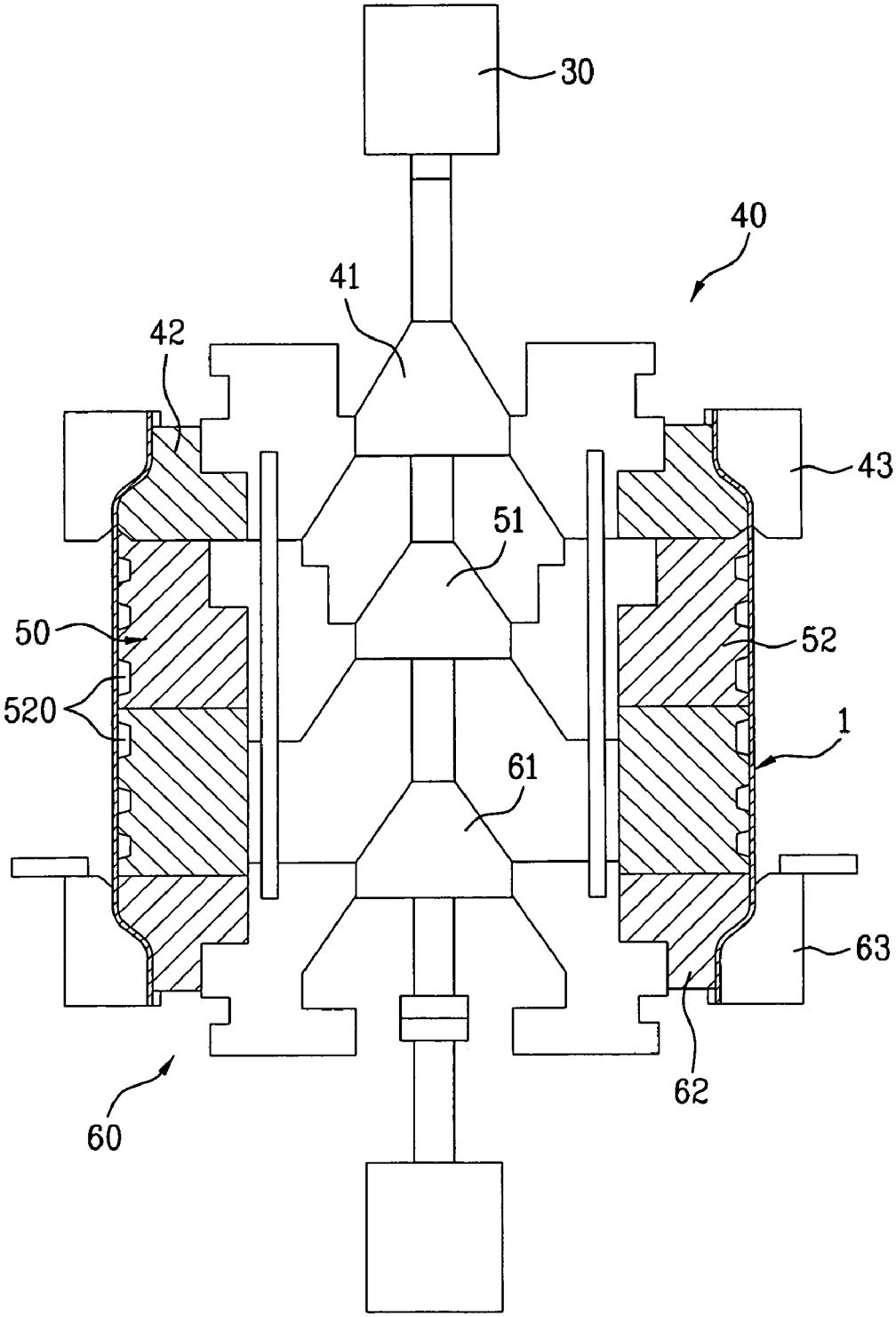

FIG. 6C illustrates reducing the upper and lower parts of the drum. As shown in FIG. 6C, after reducing the upper part of the drum 1, the upper die assembly 40 is continuously moved in a downward direction. Here, the lower part of the drum 1 is inserted between the lower core die 62 and the lower outer die 63, thereby reducing the lower part of the drum 1.

Figure 6D:
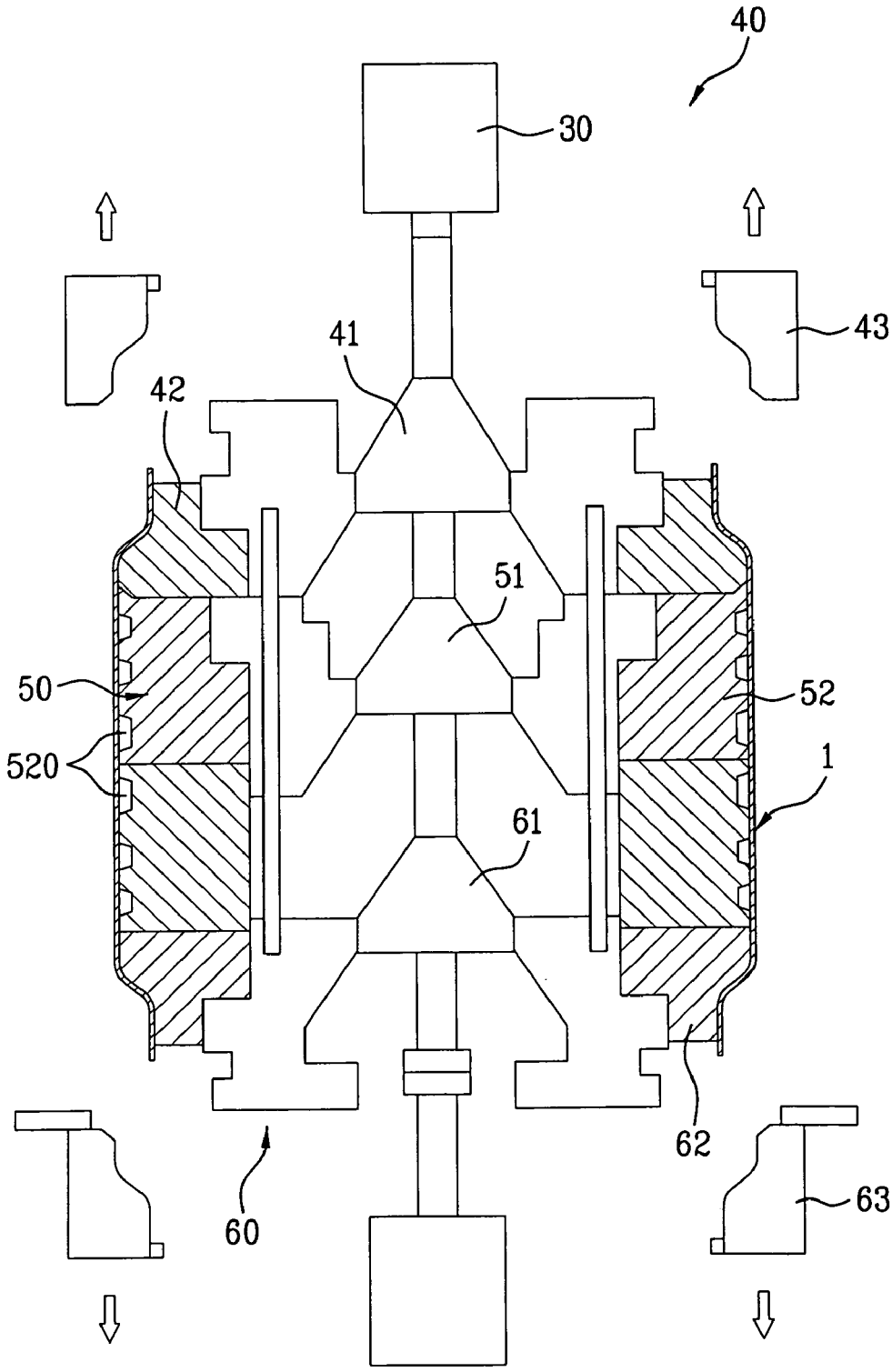

Subsequently, as shown in FIG. 6D, after reducing the lower and upper parts of the drum 1, the upper outer die 43 is moved in an upward direction, and the lower outer die 63 is moved in a downward direction, whereby the respective outer dies are cast off.

Figure 6E:
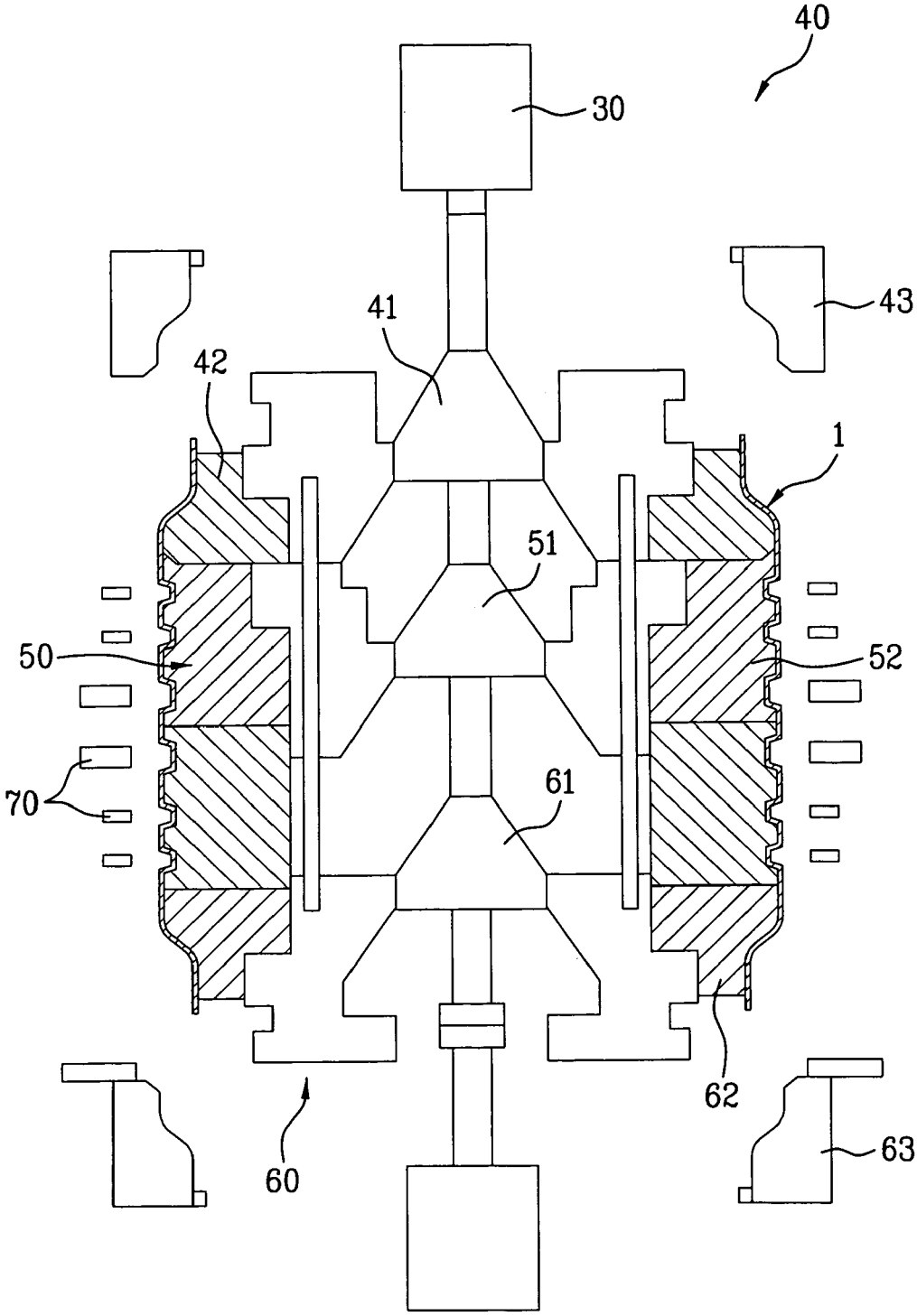

FIG. 6E illustrates forming beads in a central part of the drum. As the motor 30 is driven, the core dies are rotated. Thus, the rollers 70 are moved to the corresponding grooves (520 of FIG. 6D) of the core die 52, and the rollers 70 press the outer surface of the drum 1. As the rollers 70 press the outer surface of the drum 1, the outer surface corresponding to the central part of the drum 1 is pressed along the grooves with the rollers 70, thereby forming the beads.

Figure 6F:
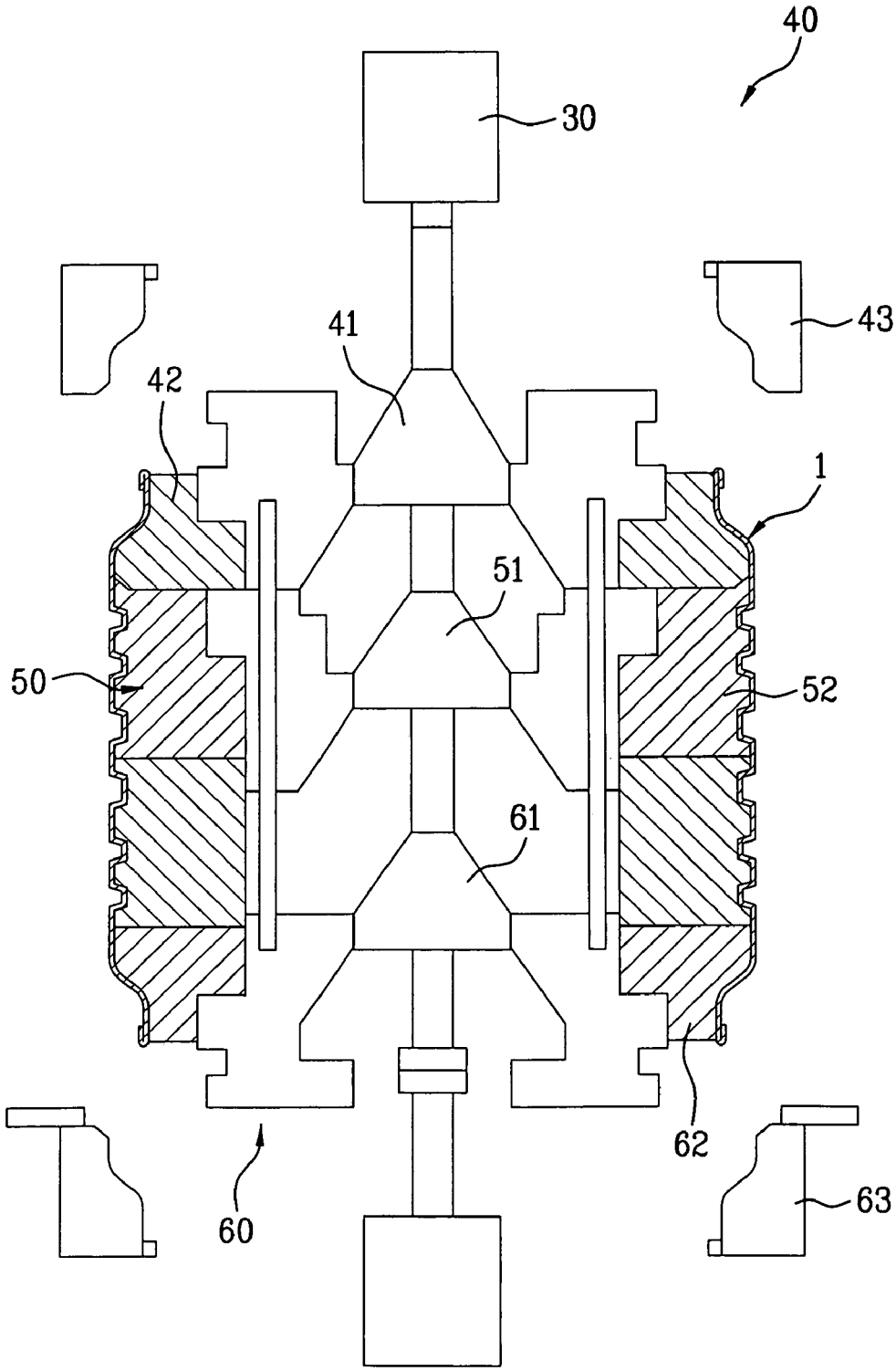
Figure 6G:
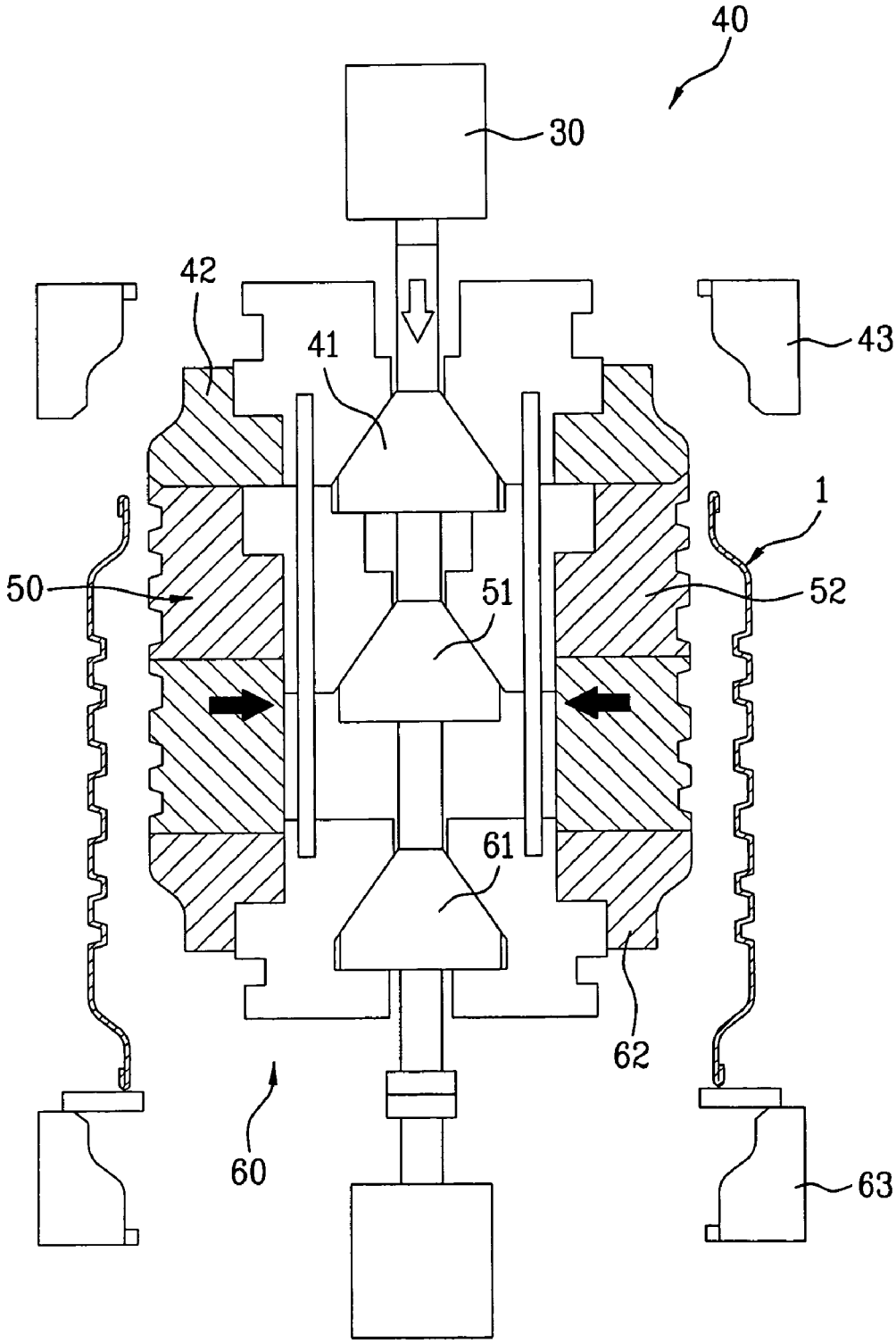

As shown in FIG. 6F, after forming the beads, both edges of the drum 1 are bent. More specifically FIG. 6F refers to a hemming process, which involves bending the edge of the drum back on itself, as shown.

FIG. 6G illustrates that the core die is contracted for separation from the drum.

At this time, the core dies 42, 52 and 62 are contracted according to an arrow direction as shown in the Figure, whereby the core dies 42, 52 and 62 are separated from the drum 1. Accordingly, the drum 1 loosens from the core dies 42, 52 and 62. Before the core dies are contracted, the lower outer die 63 is moved so as to support the lower part of the drum 1.

Figure 6H:
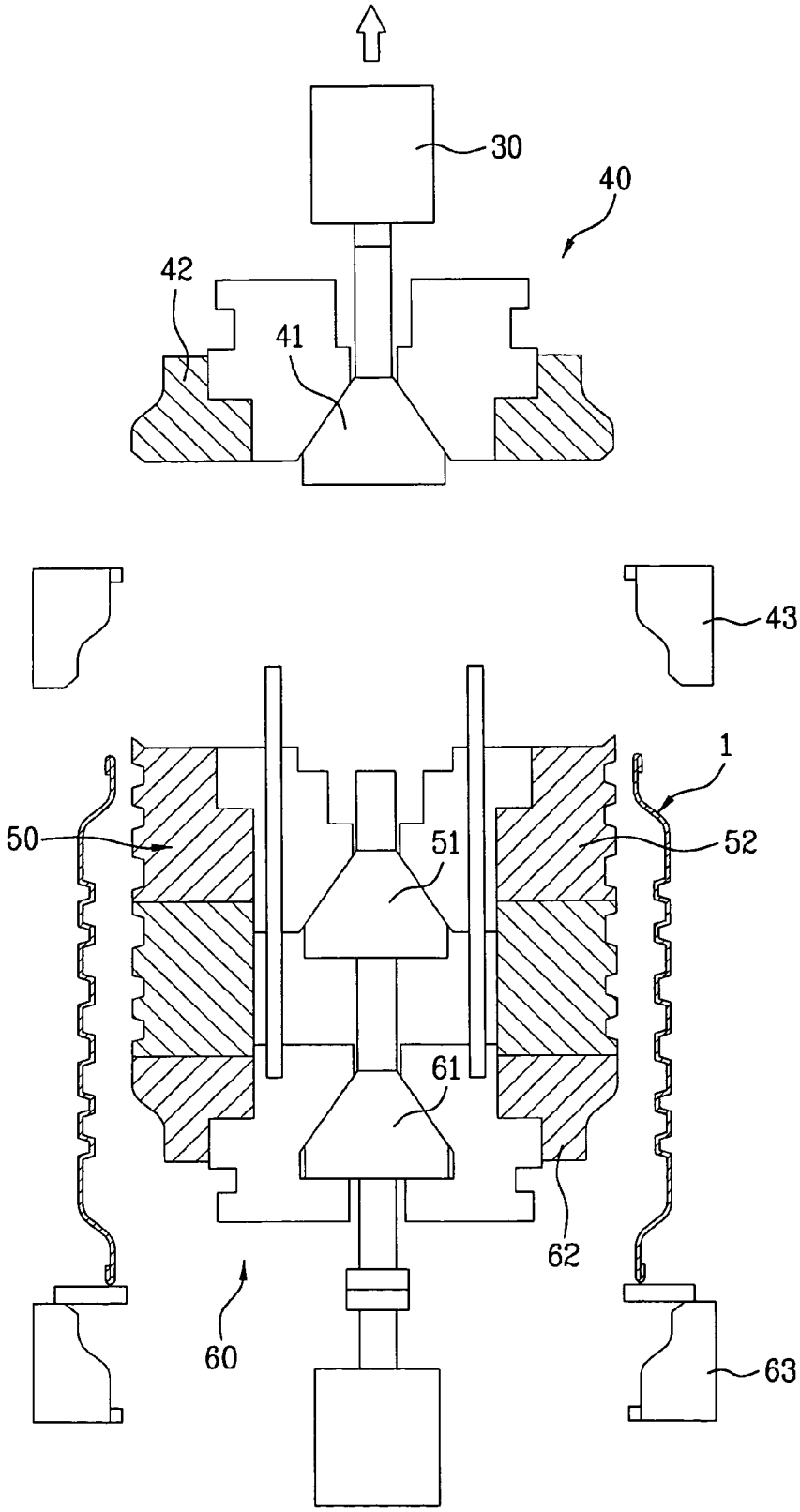

FIG. 6H illustrates the drum 1 and the apparatus after the upper die assembly is moved in an upward direction. When the upper die assembly 40 is moved in an upward direction, interference between the drum and the apparatus of manufacturing the drum is avoided. Thus, the drum is removed from the apparatus which manufactured the drum.

The apparatus and method of manufacturing the drum according to the present invention has the following advantages.

In accordance with the present invention, both ends of the drum are reduced instead of expanding the central part of the drum, whereby the pressing traces do not remain on the central part of the drum. Also, since the central part of the drum is not pressed outward, it is possible to maintain the central part of the drum in the uniform cylindrical shape, thereby preventing vibration and noise during rotation the drum. Accordingly, it is possible to improve reliability.

The method of manufacturing the drum according to the present invention is applied to the dryer. However, the method of manufacturing the drum according to the present invention may be used for other like appliances, such as washing machines.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method of manufacturing an appliance drum comprising the steps of:

orienting a cylindrical drum on a first die assembly comprising a central die having grooves adapted for use in beading a center portion of the cylindrical drum;

reducing a first diameter at one end of the cylindrical drum on the first die assembly;

reducing a second diameter at another end of the cylindrical drum on the first die assembly;

forming beads in the center portion of the cylindrical drum using the grooves on the central die of the first die assembly; and hemming both edges of the cylindrical drum all while on the first die assembly.

2. The method as claimed in claim 1, wherein the cylindrical drum is formed by:

rolling a metal sheet into a cylindrical shape; and welding a seam.

3. The method as claimed in claim 2, wherein the metal sheet is stainless steel.

4. The method as claimed in claim 1, wherein said step of reducing the diameter at both ends of the cylindrical drum comprises the step of:

inserting the ends of the cylindrical drum between dies provided at inner and outer surfaces of the drum.

5. The method as claimed in claim 1, wherein said step of forming beads in a center portion of the cylindrical drum comprises the step of:

pressing an outer surface of the drum into the grooves of the central die using rollers.

6. The method as recited in claim 2, wherein the seam is the seam of the rolled metal sheet.

7. The method according to claim 1, wherein said hemmed edges are on portions of the drum having reduced diameters.

8. The method according to claim 1, further comprising separating the cylindrical drum from the first die assembly after both edges are hemmed.

9. The method according to claim 1, wherein said hemmed edges of the cylindrical drum are positioned on an exterior portion of the cylindrical drum.

10. The method of claim 1, wherein the first and second diameters are equal.

11. The method of claim 1, wherein the first and second diameters are different.

* * * * *